US011241083B2

(12) United States Patent
Powell et al.

(10) Patent No.: US 11,241,083 B2
(45) Date of Patent: Feb. 8, 2022

(54) CLEANSING BRUSH HEAD

(71) Applicant: Chirp Products LLC, Pleasant Grove, UT (US)

(72) Inventors: Steven D. Powell, Provo, UT (US); Joshua D. Nelson, Hollister, CA (US)

(73) Assignee: Chirp Products, LLC, Pleasant Grove, UT (US)

( * ) Notice: Subject to any disclaimer, the term of this patent is extended or adjusted under 35 U.S.C. 154(b) by 335 days.

(21) Appl. No.: 16/035,026

(22) Filed: Jul. 13, 2018

(65) Prior Publication Data

US 2019/0014899 A1 Jan. 17, 2019

Related U.S. Application Data

(60) Provisional application No. 62/532,299, filed on Jul. 13, 2017.

(51) Int. Cl.

| | |
|---|---|
| ***A46B 13/02*** | (2006.01) |
| ***A46B 9/00*** | (2006.01) |
| ***A46B 9/02*** | (2006.01) |
| ***A46B 13/00*** | (2006.01) |
| ***A47K 7/02*** | (2006.01) |

(52) U.S. Cl.

CPC ..... *A46B 13/023* (2013.01); *A46B 9/005* (2013.01); *A46B 9/025* (2013.01); *A46B 9/026* (2013.01); *A46B 13/008* (2013.01); *A46B 13/02* (2013.01); *A47K 7/02* (2013.01); *A46B 2200/1006* (2013.01)

(58) Field of Classification Search

CPC ..... A46B 13/023; A46B 13/02; A46B 9/005; A46B 9/025; A46B 13/008; A46B 9/026; A46B 2200/1006; A46B 1/00; A46B 3/00; A46B 2200/102; A46B 9/12; A47K 7/02

See application file for complete search history.

(56) References Cited

U.S. PATENT DOCUMENTS

| | | | |
|---|---|---|---|
| 4,378,804 | A | 4/1983 | Cortese |
| D276,480 | S | 11/1984 | Nigro |
| 4,919,117 | A | 4/1990 | Muchisky et al. |
| D319,120 | S | 8/1991 | Kuhn |
| 5,909,720 | A | 6/1999 | Tamaoka et al. |

(Continued)

FOREIGN PATENT DOCUMENTS

| | | |
|---|---|---|
| CN | 102008359 A | 4/2011 |
| CN | 303110427 | 2/2015 |

(Continued)

OTHER PUBLICATIONS

IEEE Wiring Matters, 2008, The Institution of Engineering and Technology, Section 559 p. 4. https://electrical.theiet.org/media/1613/section-559-luminaires-and-lighting-installations-an-overview.pdf (Year: 2008).*

(Continued)

*Primary Examiner* — Kendra D Carter
*Assistant Examiner* — Arielle Wolff
(74) *Attorney, Agent, or Firm* — Nicholson De Vos Webster & Elliott LLP; Judith Szepesi

(57) ABSTRACT

A cleansing brush head for a facial brush is described. The brush head has connector to couple the brush head to a brush body, and radially symmetric ribbons forming ribbons and channels out of silicone or a similar material.

20 Claims, 10 Drawing Sheets

(56) References Cited

U.S. PATENT DOCUMENTS

| | | | | |
|---|---|---|---|---|
| 6,032,313 | A | 3/2000 | Tsang | |
| D439,052 | S | 3/2001 | Hay | |
| 6,278,195 | B1 | 8/2001 | Yamaguchi et al. | |
| 6,359,800 | B1 | 3/2002 | Liang et al. | |
| 6,359,900 | B1 | 3/2002 | Dinakar et al. | |
| 6,598,255 | B1 * | 7/2003 | Gohda | A46B 13/008 15/102 |
| D523,809 | S | 6/2006 | Roth et al. | |
| 7,157,816 | B2 | 1/2007 | Pilcher et al. | |
| D549,964 | S | 9/2007 | Roth et al. | |
| 7,267,673 | B2 | 9/2007 | Pilcher et al. | |
| 7,320,691 | B2 | 1/2008 | Pilcher et al. | |
| 7,386,906 | B2 | 6/2008 | Roth et al. | |
| D601,803 | S | 10/2009 | Reishus et al. | |
| 7,757,327 | B2 | 7/2010 | Filsouf | |
| 7,786,626 | B2 | 8/2010 | Reishus et al. | |
| 7,789,092 | B2 | 9/2010 | Akridge et al. | |
| D634,707 | S | 3/2011 | Hosler et al. | |
| D635,294 | S | 3/2011 | Hosler et al. | |
| 8,032,965 | B2 | 10/2011 | Asada et al. | |
| 8,177,450 | B2 | 5/2012 | Zhang | |
| D663,893 | S | 7/2012 | Hosler et al. | |
| 8,272,862 | B2 | 9/2012 | Pilcher et al. | |
| D683,139 | S | 5/2013 | Chikos et al. | |
| 8,468,634 | B2 | 6/2013 | Iwahori et al. | |
| 8,469,909 | B2 | 6/2013 | Pilcher et al. | |
| 8,500,754 | B2 | 8/2013 | Hull, Jr. | |
| 8,530,484 | B2 | 9/2013 | Akridge | |
| 8,595,887 | B2 | 12/2013 | Hiltmann | |
| 8,641,702 | B2 | 2/2014 | Pilcher et al. | |
| 8,661,596 | B2 | 3/2014 | Jungnickel et al. | |
| 8,668,618 | B2 | 3/2014 | Sappenfield | |
| 8,684,883 | B2 | 4/2014 | Sappenfield | |
| 8,740,917 | B2 | 6/2014 | Pilcher et al. | |
| 8,813,292 | B2 | 8/2014 | Driesen et al. | |
| 9,032,576 | B2 | 5/2015 | Zelickson et al. | |
| 9,089,390 | B2 | 7/2015 | Klemm et al. | |
| D743,174 | S | 11/2015 | Von Berg | |
| D744,755 | S | 12/2015 | Reishus et al. | |
| D770,181 | S | 11/2016 | Reishus et al. | |
| D771,951 | S | 11/2016 | Reishus et al. | |
| 10,022,025 | B2 | 7/2018 | Powell et al. | |
| 10,213,065 | B2 | 2/2019 | Powell et al. | |
| 2007/0011836 | A1 | 1/2007 | Brewer et al. | |
| 2007/0220689 | A1 | 9/2007 | Choi | |
| 2007/0245506 | A1 | 10/2007 | Clements | |
| 2008/0160509 | A1 | 7/2008 | Akridge et al. | |
| 2008/0219528 | A1 | 9/2008 | Edgar et al. | |
| 2009/0198159 | A1 * | 8/2009 | Linzell | A61H 7/003 601/138 |
| 2009/0306577 | A1 | 12/2009 | Akridge et al. | |
| 2010/0222719 | A1 | 9/2010 | Cowie et al. | |
| 2010/0300479 | A1 | 12/2010 | Reishus et al. | |
| 2011/0067194 | A1 | 3/2011 | Al-Qaffas | |
| 2011/0082409 | A1 | 4/2011 | Reishus et al. | |
| 2011/0290052 | A1 | 12/2011 | Sappenfield | |
| 2012/0165710 | A1 | 6/2012 | Nichols | |
| 2012/0202641 | A1 | 8/2012 | Sappenfield | |
| 2012/0233798 | A1 * | 9/2012 | Brewer | A46B 9/06 15/160 |
| 2013/0047357 | A1 | 2/2013 | Diaz | |
| 2013/0060176 | A1 | 3/2013 | Nichols | |
| 2013/0097789 | A1 | 4/2013 | Fischer et al. | |
| 2014/0096332 | A1 | 4/2014 | Kitagawa et al. | |
| 2014/0310900 | A1 | 10/2014 | Curry et al. | |
| 2014/0366288 | A1 | 12/2014 | Grez et al. | |
| 2015/0034113 | A1 | 2/2015 | Yamagishi et al. | |
| 2015/0105802 | A1 * | 4/2015 | Sedic | A61H 23/0254 606/131 |
| 2015/0132041 | A1 | 5/2015 | Muraki et al. | |
| 2015/0148685 | A1 | 5/2015 | Baym et al. | |
| 2015/0174387 | A1 | 6/2015 | McInnes et al. | |
| 2015/0202114 | A1 | 7/2015 | Pardoel et al. | |
| 2015/0305486 | A1 * | 10/2015 | Pardo | A46B 7/04 15/22.1 |
| 2015/0313354 | A1 | 11/2015 | Mongan et al. | |
| 2015/0327965 | A1 | 11/2015 | Garrigues | |
| 2016/0045081 | A1 * | 2/2016 | Kern | A46B 13/008 15/22.4 |
| 2016/0183671 | A1 | 6/2016 | Skidmore | |
| 2016/0206087 | A1 | 7/2016 | Skidmore et al. | |
| 2016/0270509 | A1 | 9/2016 | Shahrur et al. | |
| 2016/0284208 | A1 | 9/2016 | Pfenniger et al. | |
| 2017/0049278 | A1 * | 2/2017 | Thomassen | A46B 7/04 |

FOREIGN PATENT DOCUMENTS

| | | | |
|---|---|---|---|
| CN | 303129383 | | 3/2015 |
| CN | 303146118 | | 3/2015 |
| CN | 204234378 | U | 4/2015 |
| CN | 303751033 | | 7/2016 |
| EP | 1132022 | A1 | 9/2001 |
| EP | 2868293 | A1 | 5/2015 |
| JP | 2008194401 | A | 8/2008 |
| JP | 2009207537 | A | 9/2009 |
| JP | 2015-213557 | A | 12/2015 |
| KR | 30-0725342 | | 1/2014 |
| KR | 20160051304 | A | 5/2016 |
| MX | 0256860001 | | 9/2008 |
| WO | 02/71970 | A1 | 9/2002 |
| WO | 2015169606 | A1 | 11/2015 |

OTHER PUBLICATIONS

International Search Report for PCT/US2018/042059.

PCT Written Opinion for PCT/US2018/042059.

Philips Leaflet, Koninklijke Philips Electronics N.V., <http://www.p4c.philips.com/cgi-bin/cpindex.pl?scy=IT&slg=EN&ctn=SC5370/10>, Date Apr. 21, 2016, Downloaded on Jun. 13, 2016, 3 pages.

Philips User Manual, Koninklijke Philips Electronics N.V., <http://www.p4c.philips.com/cgi-bin/cpindex.pl?scy=IT&slg=EN&ctn=SC5370/10>, Downloaded on Jun. 13, 2016, 56 pages.

PCT International Preliminary Report on Patentability dated Jan. 14, 2020 for PCT/US18/42059, 9 pages.

PCT International Search Report dated Oct. 2, 2018 for PCT/US 18/42059, 2 pages.

* cited by examiner

Connector 130

Pie Slices 160
Ribbon 140
Channel 150
B
B
Cleansing Surface 170
Ribbon 140
Top of the Base 122

DETAIL A SCALE 6 : 1
Ribbon Top 148

Brush Head 110
Ribbon 140
Base 120
Connector 130
SECTION B-B

DETAIL C SCALE 12 : 1
Ribbon 140

Ribbon height 146
Channel Width 152
Ribbon Thickness 144
Ribbon 140
DETAIL D SCALE 8 : 1
Top of the Base 122

SECTION B-B

DETAIL C
SCALE 5 : 1

DETAIL A
SCALE 2 : 1

DETAIL B
SCALE 5 : 1

SECTION A-A

DETAIL C
SCALE 5 : 1

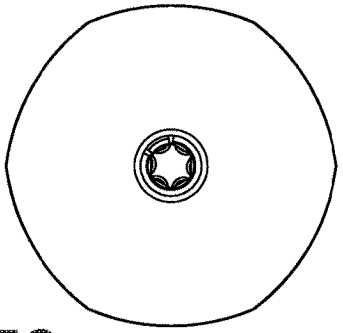
FIG. 5D
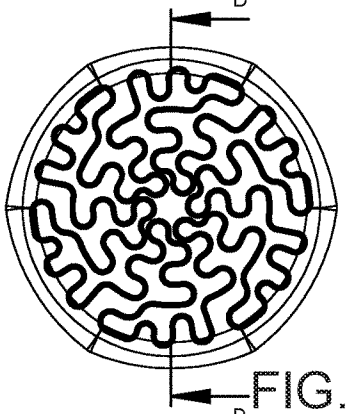
FIG. 5C
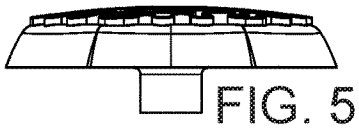
FIG. 5E
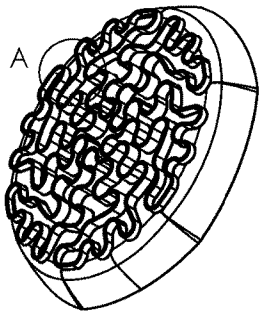
FIG. 5A
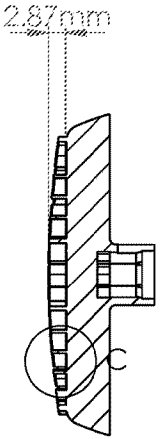
SECTION B-B
FIG. 5F
FIG. 5B
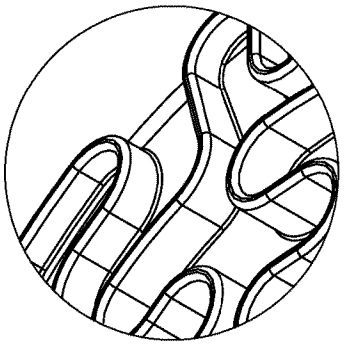
DETAIL A
SCALE 5 : 1
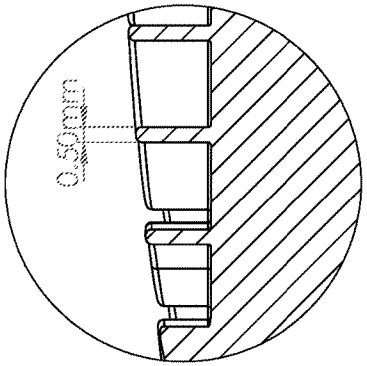
DETAIL C
SCALE 5 : 1
FIG. 5G

DETAIL A
SCALE 5 : 1

SECTION B-B
SCALE 1 : 1

DETAIL C
SCALE 5 : 1

SECTION B-B
SCALE 1 : 1

DETAIL C
SCALE 5 : 1

DETAIL A
SCALE 5 : 1

DETAIL A
SCALE 5 : 1

SECTION B-B

DETAIL C
SCALE 5 : 1

CLEANSING BRUSH HEAD

The present application claims priority to U.S. Provisional Application No. 62/532,299 filed on Jul. 13, 2017, and incorporates that application by reference in its entirety.

FIELD

The present invention relates to facial brushes, and more particularly for a brush head for a facial brush.

BACKGROUND

Brushes are used for various purposes. Facial brushes often used by women and men to wash their face. Facial brushes can help improve skin tone, reduce breakouts and blemishes, and improve the application of moisturizers and cremes. Cleaning brushes are used to clean in various environments including the home and office.

Currently there are rotating brushes, where the bristles rotate in a circular motion, to improve cleansing. Rotating bristles are useful to get the soap into the nooks and crannies of the user's face. They are also good for lathering soap.

There are also sonic brushes, in which have bristles that oscillate, rather than rotate. Sonic brushers are good at loosening embedded dirt and applying lotions.

Such brushes generally utilize a brush head with bristles arranged in a conventional configuration. Some brushes also include a massage head.

BRIEF DESCRIPTION OF THE FIGURES

The present invention I s illustrated by way of example, and not by way of limitation, in the figures of the accompanying drawings and in which like reference numerals refer to similar elements and in which:

FIGS. 1A-1H show views of a first embodiment of a brush head, in which:

FIG. 1A is a perspective view of the brush head;

FIG. 1B is a detail view of the area indicated in FIG. 1A;

FIG. 1C is a top view of the brush head;

FIG. 1D is a side view of the brush head;

FIG. 1E is a cross-section of the brush head, along the line indicated in FIG. 1C;

FIG. 1F is a zoomed-in view of a portion of the brush head indicated in FIG. 1E;

FIG. 1G is a zoomed in view of a different portion of the brush head indicated in FIG. 1E; and FIG. 1H is a back view of the brush head.

FIGS. 2A-2E show an interior view of one embodiment of a brush which may be used with the present brush head, in which:

FIG. 2A is a side perspective side view of the gearing with a transparent shell, and without motors;

FIG. 2B is a side perspective view of the gearing with a transparent shell, and with the motors;

FIG. 2C is a top perspective view of the gearing, with the motors and without the transparent shell;

FIG. 2D is a top view of the gearing; and

FIG. 2E is a side view of the gearing and motors, without the transparent shell.

FIGS. 3A-3G show views of a second embodiment of a brush head, in which:

FIG. 3A is a perspective view of the brush head;

FIG. 3B is a detail view of the area indicated in FIG. 3A;

FIG. 3C is a top view of the brush head;

FIG. 3D is a bottom view of the brush head;

FIG. 3E is a side view of the brush head;

FIG. 3F is a cross-section of the brush head, along the line indicated in FIG. 3C; and FIG. 3G is a zoomed in view of a portion of the brush head indicated in FIG. 3F.

FIGS. 4A-4G show views of a third embodiment of a brush head, in which:

FIG. 4A is a perspective view of the brush head;

FIG. 4B is a detail view of the area indicated in FIG. 4A;

FIG. 4C is a top view of the brush head;

FIG. 4D is a bottom view of the brush head;

FIG. 4E is a side view of the brush head;

FIG. 4F is a cross-section of the brush head, along the line indicated in FIG. 4C; and FIG. 4G is a zoomed in view of a portion of the brush head indicated in FIG. 4F.

FIGS. 5A-5G show views of a fourth embodiment of a brush head, in which:

FIG. 5A is a perspective view of the brush head;

FIG. 5B is a detail view of the area indicated in FIG. 5A;

FIG. 5C is a top view of the brush head;

FIG. 5D is a bottom view of the brush head;

FIG. 5E is a side view of the brush head;

FIG. 5F is a cross-section of the brush head, along the line indicated in FIG. 5C; and FIG. 5G is a zoomed in view of a portion of the brush head indicated in FIG. 5F.

FIGS. 6A-6G show views of a fifth embodiment of a brush head, in which:

FIG. 6A is a perspective view of the brush head;

FIG. 6B is a detail view of the area indicated in FIG. 6A;

FIG. 6C is a top view of the brush head;

FIG. 6D is a bottom view of the brush head;

FIG. 6E is a side view of the brush head;

FIG. 6F is a cross-section of the brush head, along the line indicated in FIG. 6C; and FIG. 6G is a zoomed in view of a portion of the brush head indicated in FIG. 6F.

FIGS. 7A-7G show views of a sixth embodiment of a brush head, in which:

FIG. 7A is a perspective view of the brush head;

FIG. 7B is a detail view of the area indicated in FIG. 7A;

FIG. 7C is a top view of the brush head;

FIG. 7D is a bottom view of the brush head;

FIG. 7E is a side view of the brush head;

FIG. 7F is a cross-section of the brush head, along the line indicated in FIG. 7C; and FIG. 7G is a zoomed in view of a portion of the brush head indicated in FIG. 7F.

FIGS. 8A-8G show views of a seventh embodiment of a brush head, in which:

FIG. 8A is a perspective view of the brush head;

FIG. 8B is a detail view of the area indicated in FIG. 8A;

FIG. 8C is a top view of the brush head;

FIG. 8D is a bottom view of the brush head;

FIG. 8E is a side view of the brush head;

FIG. 8F is a cross-section of the brush head, along the line indicated in FIG. 8C; and FIG. 8G is a zoomed in view of a portion of the brush head indicated in FIG. 8F.

DETAILED DESCRIPTION

An improved brush head is described. The brush head includes one or more radially symmetric ribbons, which form ribbons and channels on the brush head. The ribbons are made of silicone or a similar material, in one embodiment. The ribbons in one embodiment have varying heights. In one embodiment, the variation in height is smooth, forming "waves" within the ribbon. The brush head is designed to be used with a brush which combines rotation and sonic vibration. This type of dual motor brush optimizes the effect of the brush head. In one embodiment, the dual motor brush described in co-pending U.S. patent application Ser. No. 15/161,164 filed on May 20, 2016 may be used. That application is incorporated herein by reference in its entirety.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figures 1A, 1B, 1C, 1D, 1E, 1F, 1G, 1H:
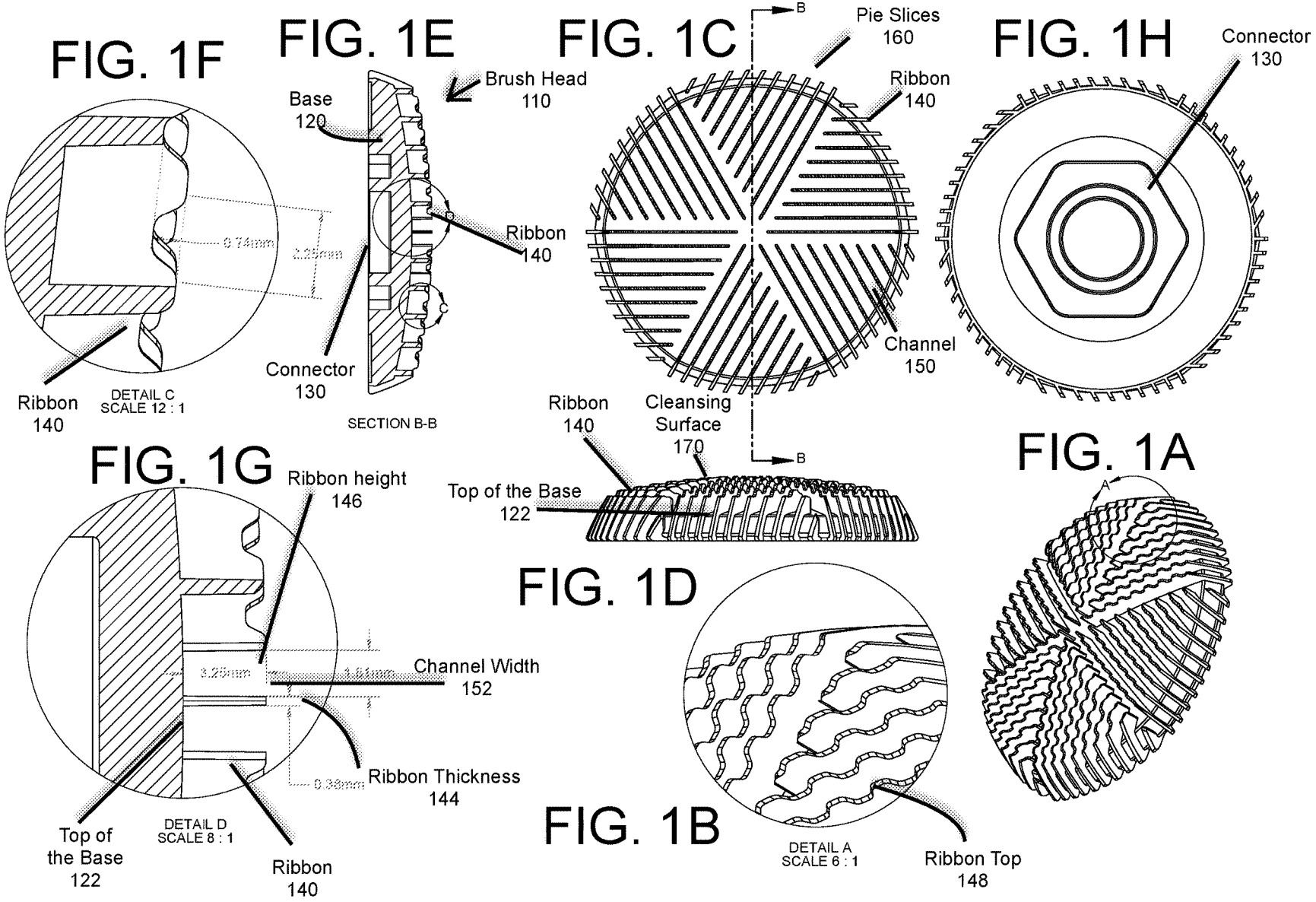

FIG. 1A-1H show various views of one embodiment of a brush head. FIG. 1A illustrates a perspective view of the brush head 110. The perspective view shows the six pie slices 160 formed by sets of aligned ribbons 140 and channels 150, and the larger channels between the pie slices 160. FIG. 1B shows the detail of the circle of FIG. 1A. As can be seen, each of the ribbons 140 has a wave-like top, with smooth changes in elevation. In one embodiment, the waves in adjacent ribbons are slightly offset, as shown in the illustration.

FIG. 1C illustrates the top view of the brush head of FIG. 1A. This view shows more clearly the pie slices, and the changes in angles between them. As can be seen, the pattern is radially symmetric, with ribbons extending toward the outer circumference of the brush head. In one embodiment, the pie slices are identical, with ribbons extending from one side of the wedge toward the outer circumference of the brush, evenly spaced. In one embodiment, the angles are horizontal, 60 degrees from horizontal, and 120 degrees from horizontal. Thus, two of the pie slices have each orientation. Note that the particular angle may be varied, and this is just an exemplary configuration. In one embodiment, the ribbons are regularly spaced within each pie slice. In another embodiment, the spacing of the ribbons may be irregular. For example, one pie slice may have a spacing of 0.5 mm while another pie slice has a spacing of 1 mm. In one embodiment, the spacing within a wedge may also vary, regularly or irregularly.

FIG. 1D is a side view, showing the brush head from the side. It shows the curved base of the brush, and the ribbons extending down the base toward the bottom of the brush head.

FIG. 1E shows a cross-sectional view at the location shown in FIG. 1C, showing the "base" 120 of the brush head 110 with the ribbons 140 and channels 150 more clearly. FIGS. 1F and 1G illustrate two detail diagrams, showing exemplary dimensions for the ribbons, waves, and channels. In one embodiment, the ribbon thickness 144 is between 0.2 mm and 0.5 mm. In one embodiment, each ribbon is 0.38 mm thick. In one embodiment, the ribbon thickness 144 does not vary along the length of a ribbon. In another embodiment, the ribbon thickness 144 may vary, for example thinning toward the edge of the brush head. In one embodiment, different ribbons may have different thickness, for example ribbons near the center may be thicker than ribbons near the edge, or vice versa.

In one embodiment, the width of the channel 150 is between 0.5 mm and 3 mm. The channel width 152 in one embodiment is 1.81 mm, that is approximately 4.5 times the width of the ribbon. In one embodiment, the wave size is consistent, and the wavelength, e.g., the distance between two peaks, is 2.25 mm. In one embodiment, the wave in the ribbon has a height difference of 0.74 mm. In one embodiment, the height 146 may vary between 0.5 mm and 1.5 mm from the top of the base 122 of the brush head 120 head to the top of a peak of a ribbon, the cleansing surface 170.

In one embodiment, the wave is not a perfect sine wave, but rather a flattened sine wave, in which the tops and bottoms of the waves are flattened. In another embodiment, the wave may be a perfect sine wave. In another embodiment, the wave may be a trapezoid wave, or another wave form. FIG. 1H illustrates the back of the brush head, showing that it includes an attachment mechanism to the brush body, the attachment mechanism comprising a connector 130 to couple the brush head to the brush body.

In one embodiment, the design of the brush head is made so that when it is used with a brush providing micro-pivots (a combination of vibratory and oscillatory motions) a soap, foam, or other such material squirted into the center of the brush head is distributed evenly toward the outside of the brush head providing a large effective area of coverage. The uneven height of the ribbon enables a more even distribution of lather and cleansing, as the brush oscillates and vibrates.

Figures 2A, 2B:
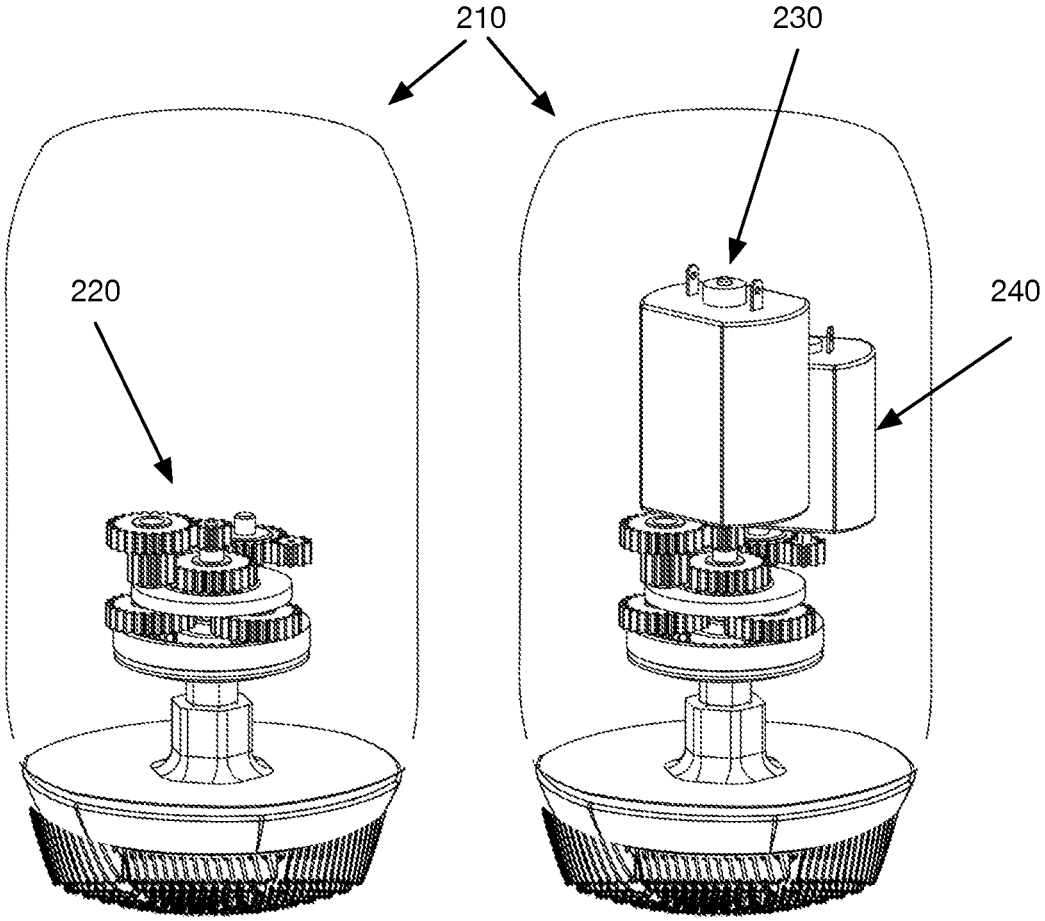

FIG. 2A is an interior view of one embodiment of the brush body which may be used with the brush head of the present application. An exemplary brush body 210 is shown in outline. The gearing 220 inside is used to combine motion from a rotation motor 230 and a sonic vibration motor 240. In one embodiment, planetary gearing is used, in which the gearing combines the rotation from the rotation motor 230 with the vibration from the vibration motor 240 to create micro-rotations. In one embodiment, the vibration motor 240 drives the annulus. The rotation motor 230 drives the sun gear. The planet gears sum those motions and move the carrier on which the brush is affixed.

In one embodiment, the planetary gearing permits adjustment of the rotation and vibration, and their ratios. FIG. 2A shows the exemplary gearing, without the motors. FIG. 2B shows one embodiment of motors 230, 240. It should be understood that the configuration shown is merely an exemplary configuration, and the present brush head may be used with a different type of brush body. Furthermore, the appearance of the brush body, brush head, gearing, and motors may be altered.

Figure 2C:
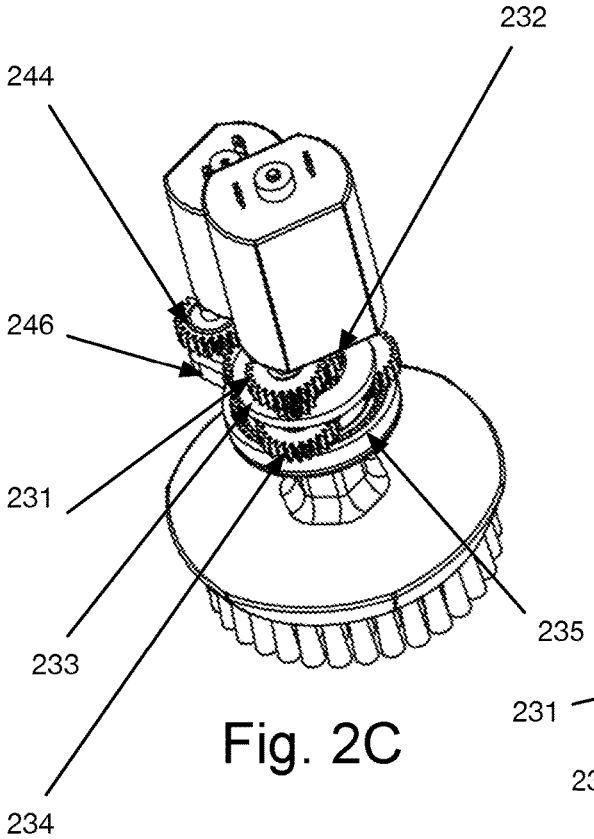

FIG. 2C shows the gearing and motors from a different perspective and shows the loop 246 which is attached to the ring gear 235 and through which the sonic vibration motor 240 moves the ring gear 235 back and forth in sonic vibration.

Figure 2D:
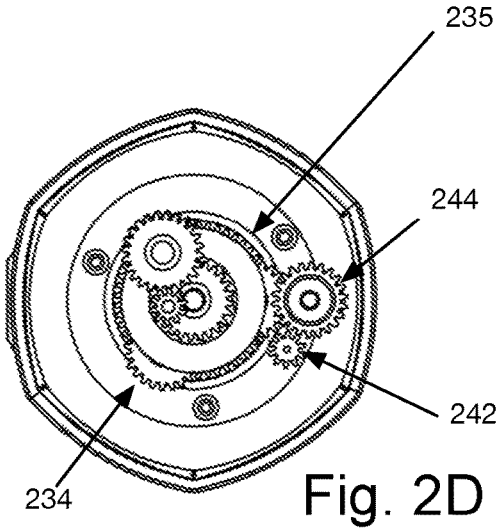
Figure 2E:
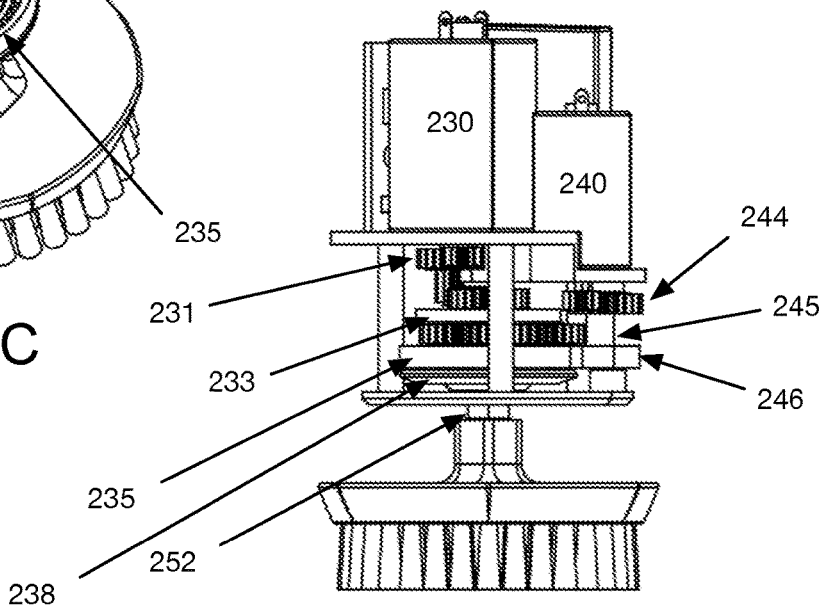
Figure 3D:
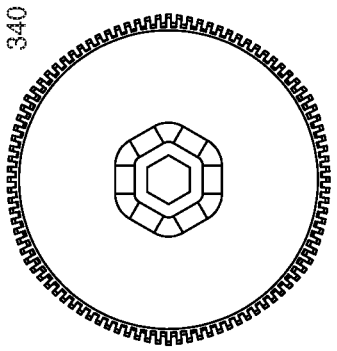
Figure 3C:
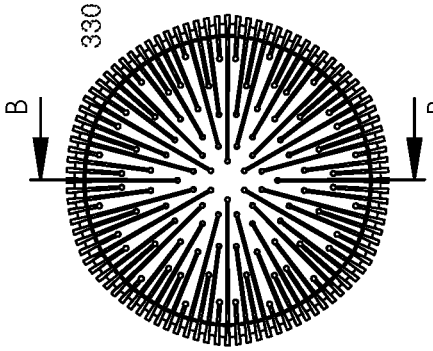
Figure 3E:
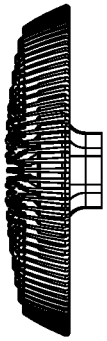
Figure 3F:
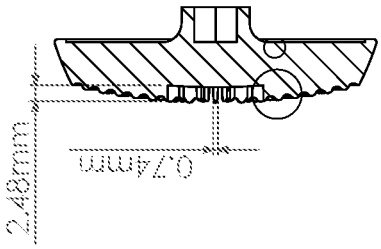
Figure 3G:
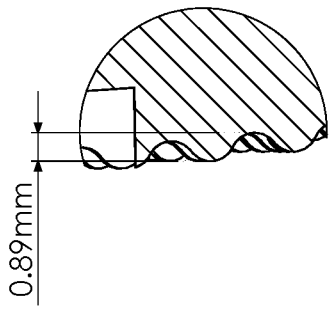
Figure 3A:
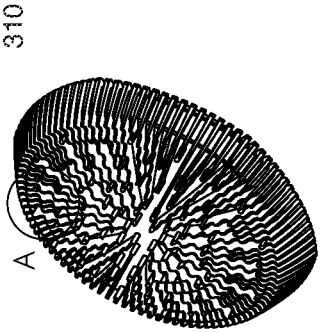
Figure 3B:
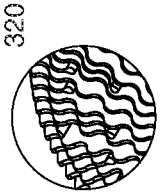
Figure 4D:
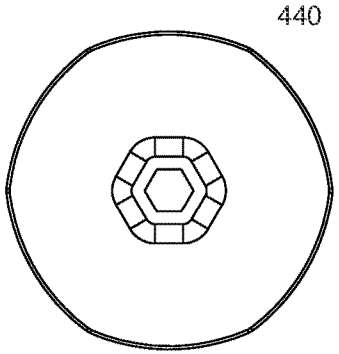
Figure 4C:
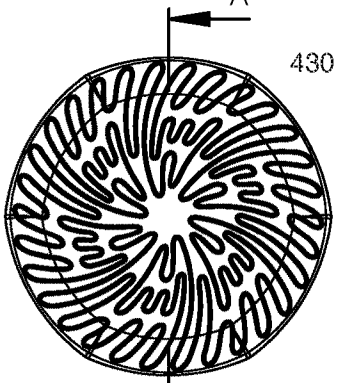
Figure 4E:
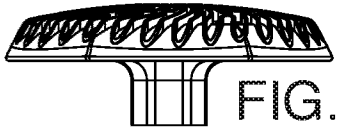
Figure 4A:
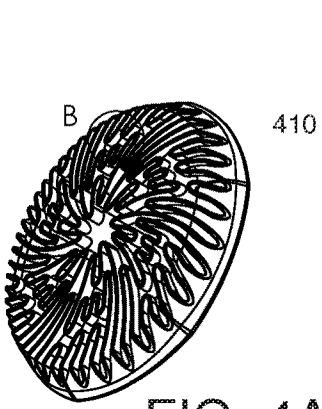
Figure 4B:
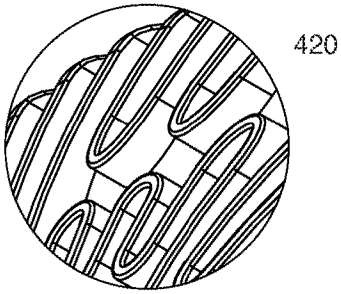
Figure 4F:
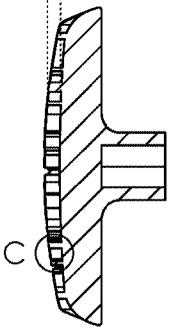
Figure 4G:
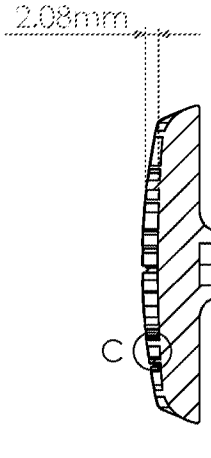
Figure 4G:
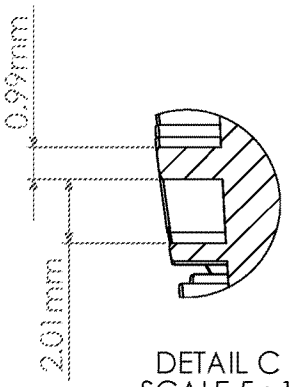
Figure 6D:
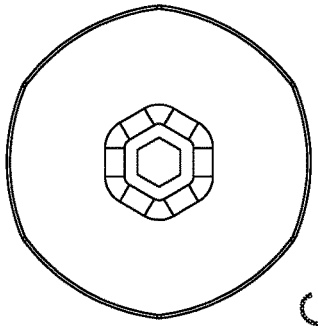
Figure 6C:
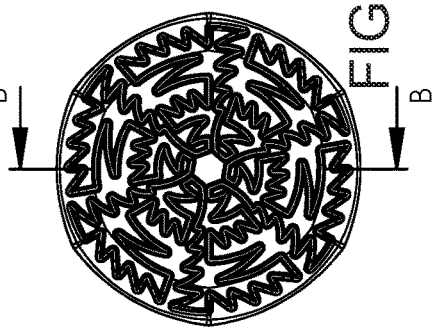
Figure 6E:
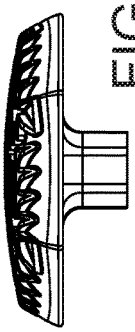
Figure 6A:
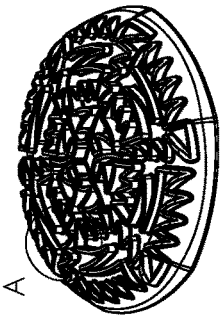
Figure 6B:
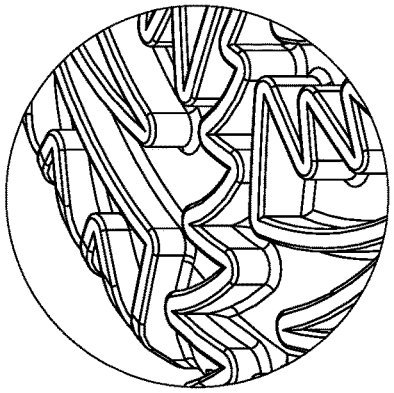
Figure 6F:
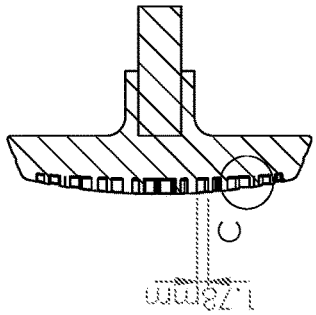
Figure 6G:
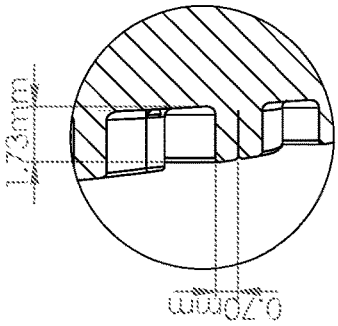
Figure 7D:
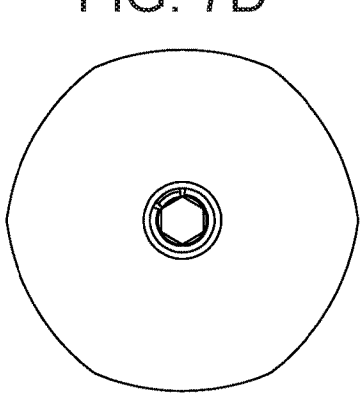
Figure 7C:
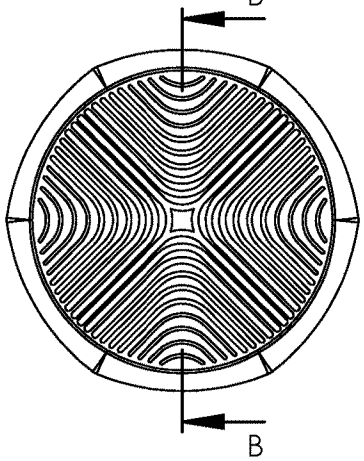
Figure 7E:
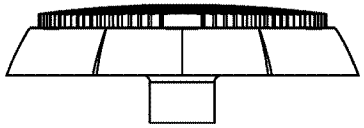
Figure 7F:
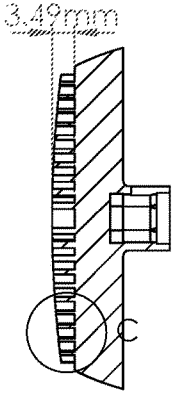
Figure 7G:
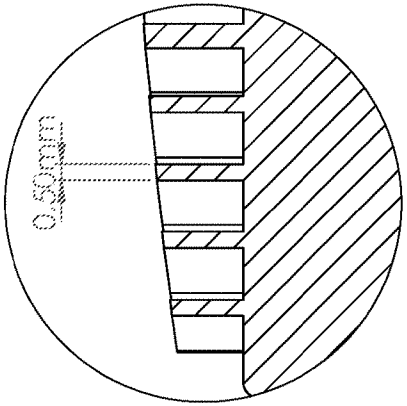
Figure 7A:
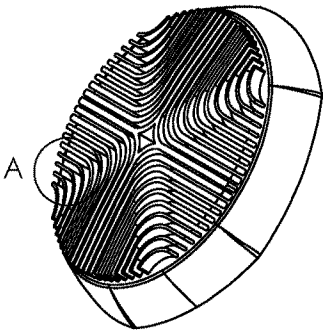
Figure 7B:
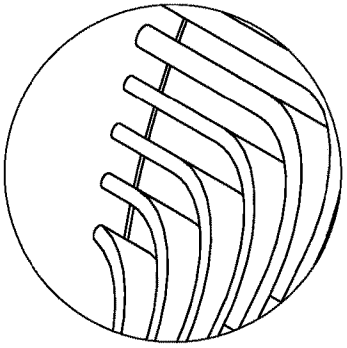
Figure 8D:
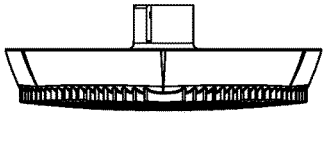
Figure 8C:
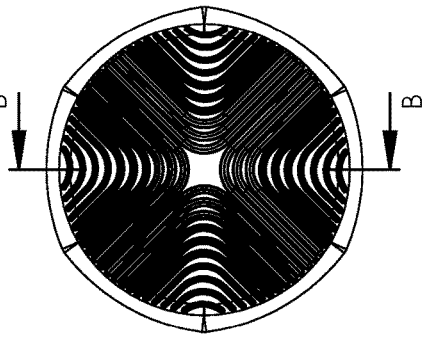
Figure 8E:
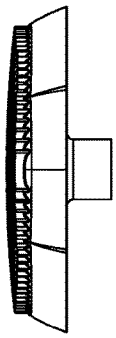
Figure 8A:
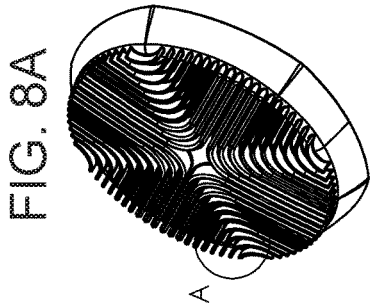
Figure 8B:
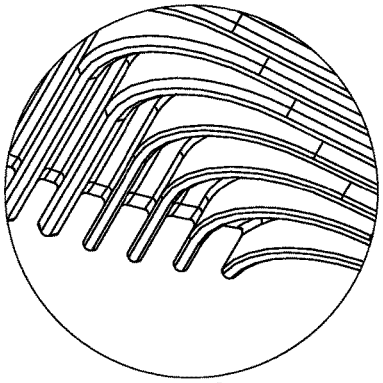
Figure 8F:
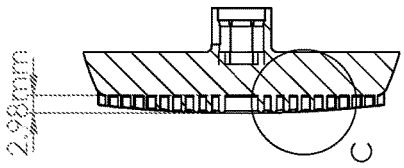
Figure 8G:
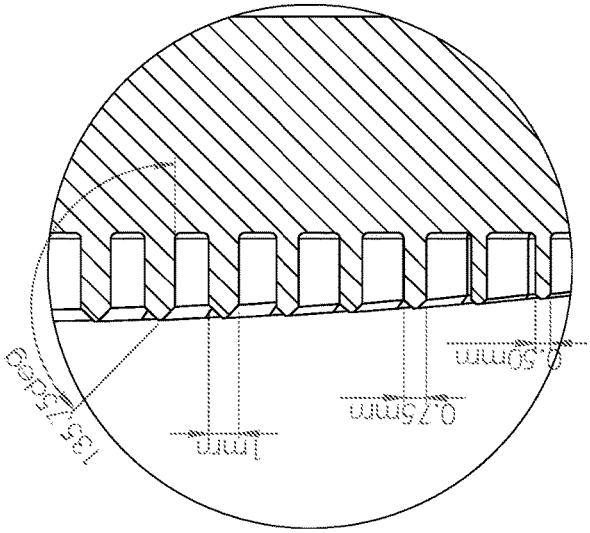

FIG. 2D shows the gearing from below, showing an exemplary planetary gearing 234, as well as the gears 242 and 244 which couple the sonic vibration motor 240 to the ring gear 235. The carrier 233 is coupled to the cover 238, which moves the shaft 252. FIG. 2E shows the gearing and motors from a different angle. The sonic vibration motor 240 moves the ring gear 235, the ring gear 235 moves the planetary gears 234 which moves the carrier 233 which moves the cover 238 which moves the shaft 252. The rotation motor 230 drives the sun gear 232 which drives the planetary gears 234 which move the carrier 233 which moves the cover 238 which moves the shaft 252. When both the sonic vibration motor 240 and the rotation motor 230 are active, the shaft 252 is driven by cover 238 which is driven by carrier 233 which is the sum of the movement through planetary gears 234 and ring gear 235.

It should be understood that the configuration shown is merely an exemplary configuration. The appearance of the brush, brush head, gearing, and motors may be altered.

FIGS. 3A-3G show views of another embodiment of a brush head. As can be seen, in this configuration the ribbons are all oriented radially and of varying lengths. The ribbons 320 remain radially symmetric. In one embodiment, the spacing of the ribbons 320 at the outer circumference 330 is even. In one embodiment, each sub-segment includes a number of ribbons. In this illustration, there are 6 sub-segments, defined by the six longest ribbons. Each sub-segment, in one embodiment, includes the same number and positioning of ribbons. In one embodiment, there is one long extension in each segment, and a total of four lengths of ribbons, from the longest which is between 70% and 90% of the radius of the brush head, to the shortest which is 10% to 25% of the radius. The other extension lengths are between these two. In one embodiment, the starting portion of each extension, which is toward the center of the brush head, has a ball nose end. In another embodiment, the ribbons may be broken up, or ribbons may terminate before the edge of the brush head. In one embodiment, each ribbon has a thickness between 0.2 mm and 0.5 mm. The top of each ribbon is wavy. In one embodiment, the wave may be sinusoidal as shown, or another shape. The uneven height of the ribbon enables a more even distribution of lather and cleansing, as the brush oscillates and vibrates.

FIGS. 4A-4G show views of another embodiment of a brush head. As can be seen in this configuration the ribbon is a single curvilinear piece, forming a flower-like shape. However, the shape created by the ribbon 420 remains radially symmetric. In one embodiment, the height of the ribbon ranges from 1.5 mm to 0 mm at the outer circumference 430 of the brush head. In another embodiment, the height range is between 0.5 mm and 1.5 mm. In one embodiment, there is a gap in the ribbon at the outside circumference so that water or other materials are not trapped within the loops of the ribbon. In one embodiment, the ribbon is of a uniform height.

FIGS. 5A-5G show another embodiment of a brush head. As can be seen in this configuration the ribbon is a single curvilinear extension which forms loops that extend from the center to the edge of the brush head. Unlike the flower-like shape of the prior embodiment, this embodiment forms shapes resembling jigsaw puzzle pieces. The shaped formed by the ribbon remains radially symmetric. In one embodiment, the height of this ribbon ranges from 0 mm to 1.5 mm. In another embodiment, the height can range from 0 mm to 2 mm. In one embodiment, the pattern for each of the portions of the shape repeats, forming a regular pattern, here shown as 6 puzzle-piece shaped patterns, which extend from the center to the edge of the brush head.

FIGS. 6A-6G illustrate one embodiment of a brush head. This embodiment includes a single ribbon as well, but rather than being curvilinear, the extension has sharp edges making a zig-zag pattern. In one embodiment, the shape created by the single ribbon remains radially symmetric, and has a consistent height of between 0.5 mm and 2 mm. In another embodiment, the height may range between 0 mm and 2 mm.

FIGS. 7A-7G illustrate one embodiment of a brush head. This embodiment includes a plurality of parabolic ribbons arranged in a way to create four segments in the circular brush head. Each segment includes a plurality of largely parallel parabolic lines. In one embodiment, the center includes a diamond shape. In one embodiment, this design remains radially symmetric, and each parabola has a consistent height of between 0.5 mm and 2 mm. In another embodiment, the height may range between 0 mm and 2 mm. In one embodiment, the spacing between the largely parallel parabolas ranges from 0.5 mm to 1 mm.

FIG. 8A-8G illustrate one embodiment of a brush head. This embodiment includes a plurality of parabolic ribbons arranged in a way to create four segments in the circular brush head. Each segment includes a plurality of largely parallel parabolic lines. In one embodiment, the tops of the largest parabolas create a shape in the center of the brush head. In one embodiment, this design remains radially symmetric, and each parabola has a consistent height of between 0.5 mm and 2 mm. In another embodiment, the height may range between 0 mm and 2 mm. In one embodiment the spacing between the largely parallel parabolas ranges from 0.2 mm to 0.5 mm. In one embodiment, the spacing of the parabolas changes between the leg of the parabola and the center portion of the parabola.

As can be seen from the variety of examples of brush heads illustrated in FIGS. 1A through 8G, the brush head includes one or more ribbons and channels, made of an elastomer, such as silicone. In another embodiment, natural or manmade rubber may be used. Other materials which provide flexibility and rigidity may be used. Other materials, such as synthetic polyisoprenes and thermoplastic elastomers (TPE) may be utilized. In one embodiment, the individual ribbons have a height between 0.2 mm and 2 mm. In one embodiment, the ribbons may have a wavy top, with the wave extending to a significant portion of the height of the ribbon. In one embodiment, the ribbon overall height (with or without the wave) may be consistent. In another embodiment, the height of some ribbons may range from the full height to 0 mm, as the termination of a particular ribbon may make the ribbon even with the edge of the brush head. In one embodiment, a spacing between ribbons may range between 0.5 mm and 2 mm at their narrowest. In some configurations, there may be portions where the spacing between ribbons is significantly greater. In some embodiments, the ribbons may have smooth curvatures, while in others the ribbons may have sharp corners.

In one embodiment, due to the material used, the brush head can be easily cleaned, under running water, in the dish washer, or in boiling water or an autoclave. In one embodiment, the shape of the ribbons of the brush head are designed to have an optically pleasing appearance when the brush is not in use, and when the brush is in use.

In one embodiment, when the brush is in use with the brush head, the brush head pattern may produce an optically pleasing appearance, due to the wagon-wheel effect, also known as a stroboscopic effect, which produces an optical illusion in which the brush head appears to rotate differently from its true rotation. This is due to the combination of rotation and vibration, when the brush head is used with the oscillating and vibrating brush described. In one embodiment, individual rows or sub-portions of the pattern may appear to rotate separately at different rates. This produces visually attractive patterns, which vary based on the settings of the brush.

Figure 9:
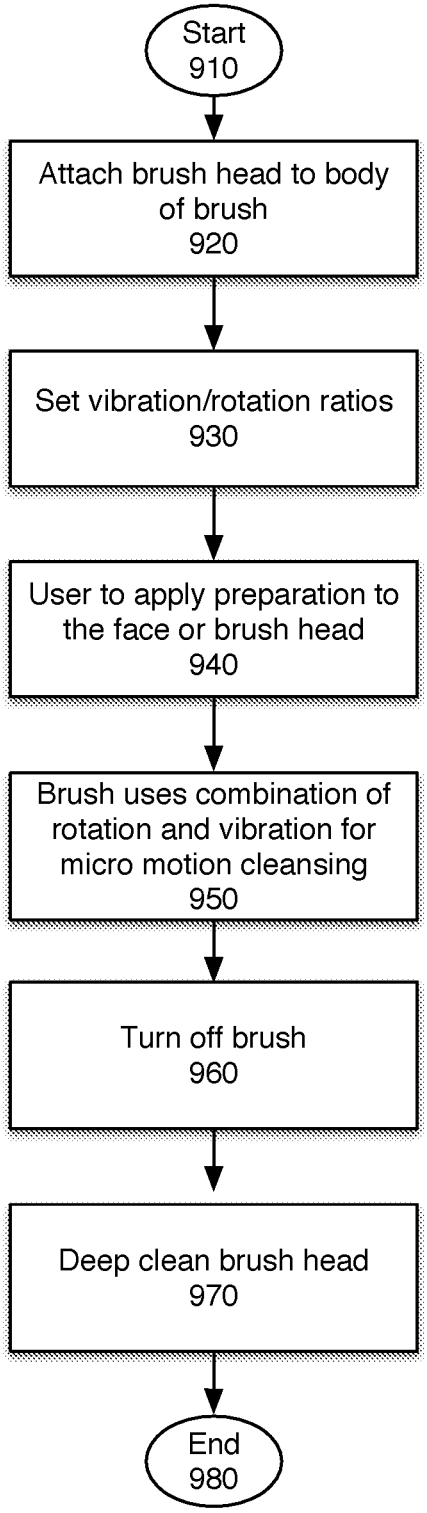
FIG. 9 is a flowchart of one embodiment of using the brush head.

FIG. 9 is a flowchart of one embodiment of using a brush with the brush head. The process starts at block 910.

At block 920, the brush head is attached to the brush. In one embodiment, this step may be done at any time, and may only be done periodically, when changing brush heads or cleaning the brush head.

At block 930, the user sets the brush settings for vibration and rotation/oscillation. As discussed in co-pending application, the brush includes both vibration and rotation motors, in one embodiment. In one embodiment, these settings may be maintained between uses.

At block 940, a preparation is applied to the user's face, or the brush head. The preparation may be a lotion, soap, cleanser, créme, or other material which may be used with the brush.

At block 950, the brush is used. The combination of rotation and vibration produces micromotions. These micromotions, with the ribbons in the brush head produce excellent cleansing results. In one embodiment, due to the shape of the ribbons in the brush head and the combination of rotation and vibration, the preparation is distributed throughout the brush head providing an excellent cleansing surface, and efficient cleansing.

At block 960, the user turns off the brush. In one embodiment, a quick rinse would be sufficient to remove the residue of the preparation and any skin particles from the silicone brush head.

However, periodically the user may wish to deep clean the brush head. At block 970, the user deep cleans the brush head. This may be done periodically, such as once a day, once a week, or once a month depending on the user's skin, preparations used, and frequency of use. In one embodiment, the user rinses the brush head after use each time. Because the brush head is silicone or another elastomer, skin particles do not cling, and it is easy to clean. In one embodiment, the brush head is made of silicone, and thus deep cleaning may include boiling, dish washer, autoclave, or any other mechanism. In one embodiment, the user is encouraged to periodically clean the brush head. In one embodiment, the brush itself may indicate that it is time to clean the brush head. This may be based on elapsed time, number of minutes of use, preparation data, weight, or other factors. The process then ends at block 980.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A brush head for a facial brush having a rotating cleansing surface designed to contact a user's face when the brush head is in use, the brush head comprising:

a base having a top and a bottom;

a connector on the bottom of the base configured to couple the brush head to a brush body;

one or more ribbons and channels on the top of the base, the ribbons having dimensions of length, width, and height, the length defined as a longest dimension of the ribbon, and the height being a distance from the top of the base to a portion of the ribbon that is designed to be in contact with the user's face, the ribbons being radially symmetric, with width being consistent along the length, and at least one of the one or more ribbons having smoothly varying height along the length of the ribbon, wherein a center portion of the cleansing surface of the brush head is higher than an outside of the cleansing surface of the brush head.

2. The brush head of claim 1, wherein each of the one or more ribbons extends straight from a center location toward an exterior circumference of the brush head.

3. The brush head of claim 2, wherein each of the one or more ribbons is less than one half the diameter of the brush head.

4. The brush head of claim 1, wherein each of the one or more ribbons is curvilinear.

5. The brush head of claim 1, wherein the one or more ribbons cumulatively form a pattern which is configured to direct water and lotion toward an exterior circumference of the brush head.

6. The brush head of claim 1, wherein a set of parallel ribbons, each having a different length, form a wedge shape, and the brush head includes a plurality of wedge shapes.

7. The brush head of claim 1, wherein the brush head is made of silicone.

8. The brush head of claim 1, wherein the varying height of each of the one or more ribbons is between 0.5 mm and 1.5 mm from a base of the brush head.

9. The brush head of claim 1, wherein at least one of the one or more ribbons extends beyond the edge of the brush head.

10. A facial brush comprising:

a brush body;

a brush head having a cleansing surface designed to contact a user's face when the facial brush is in use;

a connector on a bottom of the brush head, to couple the brush head to the brush body;

one or more ribbons forming ribbons and channels, each ribbon having dimensions of length, width, and height, the length defined as a longest dimension, the length of each ribbon being at least 10% of a radius of the brush head, and each ribbon having a varying height along the length, and each ribbon having a consistent width along the length and a substantially consistent width along the height;

the one or more ribbons being radially symmetric and on a second side of the brush head, the ribbons being substantially evenly spaced, and made of an elastomer, the cleansing surface being higher in a center of the brush head than at edges of the brush head.

11. The brush head of claim 10, wherein the one or more ribbons have curvilinear shapes.

12. The brush head of claim 11, wherein the curvilinear shape is parabolic.

13. The brush head of claim 10, wherein a spacing of the one or more ribbons varies between 0.5 mm and 3 mm.

14. The brush head of claim 10, wherein a height of the one or more ribbons is between 0.5 mm and 2 mm from a base of the brush head.

15. The brush head of claim 14, wherein the one or more ribbons vary in height by between 0.5 mm and 2 mm.

16. The brush head of claim 10, wherein the elastomer comprises silicone.

17. The brush head of claim 16, wherein the silicone of the brush head is smooth and easily cleansed to remove a preparation and exfoliated skin particles.

18. The brush head of claim 10, wherein the brush body includes a rotation motor and a vibration motor, and the brush head is configured to make micromotions in use.

19. A brush comprising:

a brush body designed to fit a brush head attachment;

a first motor to provide rotational movement to the brush head;

a second motor to provide vibrational movement to the brush head; and the brush head comprising one or more ribbons, the one or more ribbons being radially symmetric and substantially evenly spaced, and made of an elastomer, the brush head having a non-planar cleansing surface, and configured to move with micromotions when the first motor and the second motor are on, the one or more ribbons having dimensions of length, width, and height, the length defined as a longest dimension of the ribbon, and the height being a distance from the top of the base to a portion of the ribbon that is designed to be in contact with a user's face, the ribbons being radially symmetric, with the width consistent along the length of the ribbon and the width being substantially consistent along the height of the ribbon.

20. The brush of claim 19, wherein the one or more radially symmetric ribbons are designed such that the brush head creates a wagon-wheel effect optical illusion when the first motor and the second motor are on, under continuous illumination.

* * * * *